US010206424B1

(12) United States Patent
Gammerler et al.

(10) Patent No.: US 10,206,424 B1
(45) Date of Patent: Feb. 19, 2019

(54) RADIANT HEATING SYSTEM FOR VAPORIZING TOBACCO AND METHOD OF USE

(71) Applicants: Gunter Gammerler, Palmetto, FL (US); Maximilian Frank, Osprey, FL (US)

(72) Inventors: Gunter Gammerler, Palmetto, FL (US); Maximilian Frank, Osprey, FL (US)

(73) Assignee: MG Heat, LLC, Bradenton, FL (US)

( * ) Notice: Subject to any disclaimer, the term of this patent is extended or adjusted under 35 U.S.C. 154(b) by 342 days.

(21) Appl. No.: 15/254,246

(22) Filed: Sep. 1, 2016

(51) Int. Cl.

| | |
|---|---|
| ***F24F 3/14*** | (2006.01) |
| ***A24F 1/30*** | (2006.01) |
| ***A24F 47/00*** | (2006.01) |
| ***H05B 3/76*** | (2006.01) |
| ***H05B 3/12*** | (2006.01) |
| ***C22C 19/05*** | (2006.01) |
| ***C22C 38/18*** | (2006.01) |
| ***C22C 38/06*** | (2006.01) |
| ***C22C 9/06*** | (2006.01) |
| ***C22C 9/05*** | (2006.01) |

(52) U.S. Cl.
CPC ..... *A24F 1/30* (2013.01); *A24F 47/008* (2013.01); *C22C 9/05* (2013.01); *C22C 9/06* (2013.01); *C22C 19/058* (2013.01); *C22C 38/06* (2013.01); *C22C 38/18* (2013.01); *H05B 3/12* (2013.01); *H05B 3/76* (2013.01); *H05B 2203/032* (2013.01)

(58) Field of Classification Search
None
See application file for complete search history.

(56) References Cited

U.S. PATENT DOCUMENTS

| | | | | |
|---|---|---|---|---|
| 3,918,464 | A * | 11/1975 | Kolodziej | A24F 1/30 131/173 |
| 4,133,318 | A * | 1/1979 | Gross | A24F 1/30 131/173 |
| 5,049,726 | A * | 9/1991 | Higgins | H05B 3/742 219/462.1 |
| 7,565,908 | B2 * | 7/2009 | Liu | A24F 1/30 131/173 |
| 8,983,282 | B2 * | 3/2015 | Bishara | F24H 3/002 131/173 |
| 9,237,770 | B2 | 1/2016 | Bavar | |
| 2006/0086365 | A1 * | 4/2006 | Liu | A24F 1/30 131/173 |
| 2007/0056599 | A1 | 3/2007 | Zoumut | |

(Continued)

*Primary Examiner* — Thor Campbell
(74) *Attorney, Agent, or Firm* — Robert Varkonyi; Zagrebelsky Law P.A.

(57) ABSTRACT

A radiant heater adapted to fit on the head of a hookah. The heater uses one or more resistance ribbons to generate heat which is transferred to shisha in the hookah. The heater includes a chimney which surrounds the resistance ribbon and provides a chimney siphoning to remove heat when the heater is not in use and a heat transfer plate which includes one or more projections to vent excess heat. Air is drawn through the top of the chimney and is heated by the resistance ribbon. The heated air mixes with cool air drawn through a ventilation space below the chimney and the mixed air drawn through one or more vents in a heat plate. The heat transfer plate and hot air vaporize the shisha.

20 Claims, 11 Drawing Sheets

(56) References Cited

U.S. PATENT DOCUMENTS

| | | | | |
|---|---|---|---|---|
| 2010/0126516 | A1* | 5/2010 | Yomtov | A24F 1/30 131/173 |
| 2010/0212678 | A1* | 8/2010 | Bishara | A24F 1/30 131/173 |
| 2010/0212679 | A1* | 8/2010 | Bishara | A24F 1/30 131/173 |
| 2014/0069446 | A1 | 3/2014 | Haddad | |

* cited by examiner

RADIANT HEATING SYSTEM FOR VAPORIZING TOBACCO AND METHOD OF USE

FIELD OF INVENTION

The invention relates generally to an electrical radiant heating system and method of vaporizing tobacco. Specifically, the invention discloses a plurality of electrical heating coils designed to heat tobacco to vaporize without burning the tobacco.

BACKGROUND OF INVENTION

Hookah are devices used in smoking combusted materials such as tobacco. They consist of a head, body, vase, and hose. The head is a bowl formed of clay, marble, or glass, that contains coal and tobacco separated by a screen or perforated metal foil. Commonly, a windscreen is placed on the upper opening of the head, limiting air exposure to the coal, and reducing the burn rate, and hence temperature, of the coal. The body consists of a pipe that joins the head to the vase. The lower end of the pipe is submerged in water to provide a filtration system for the tobacco vapor. In some variations, a diffuser is fitted to the end of the pipe, reducing the size of the bubbles forming as air is drawn from the body into the water. The vase is a water-filled container possessing at least an input for the body and an output for one or more hoses. Finally, the hose is a material, commonly flexible, fitted to the vase and terminating in a mouthpiece.

Tobacco is placed in the head of the hookah and heated to generate smoke, traditionally using charcoal that is separated from the tobacco by a perforated foil, glass, or metal screen. Hot air from the charcoal vaporizes the tobacco. Smoke vapor is drawn through a channel in the body and into the vase as a user draws air through the mouthpiece. As the body extends into water in the vase, the smoke vapor bubbles in the water, thereby filtering the raw smoke vapor. The smoke vapor then enters a head space in the vase, which is in direct communication with the one or more hoses and is drawn to the user.

The origins of the hookah are traced to Rajasthan province in north western India or Persia, and consisted of a simple and rugged structure, typically derived from a coconut shell base with a tube and head attached, which is where the alternative name for the device—nārghile (sanskrit, n ārikela, coconut)-originated. In the 1500s, Abu-al Fath Gilani was attributed with the general development of the hookah as it is commonly known today. Though as the hookah was adopted in the Ottoman Empire, hookahs grew in size and complexity, and changed materials, using less wood and more brass and glass.

However, the traditional hookah rely upon charcoal, which introduces unwanted chemicals and carcinogens into the vapor smoke, and forms dirty byproducts like soot, some of which can access the tobacco. Electric solutions have thus far been unsuccessful, as the designs cause overheating of the tobacco or result in wide temperature variations in the heating element, which reduces proper vaporization and negatively affects a hookah user's experience. As such, there is an unmet need in the art for a clean and effective method to vaporize tobacco.

SUMMARY OF THE INVENTION

Disclosed is a radiant heating system, comprising a heating element, a support structure, and an electrical source.

The heating element is formed of one or more heating coils of resistance wire. The resistance wire can be an alloy of nickel, aluminum, copper, manganese, iron, chromium, and silicon. Non-limiting examples include an alloy of nickel (80%) to chromium (20%), an alloy of iron (62.5%-76%) to chromium (20%-30%) to aluminum (4%-7.5%), an allow of copper (55%) to nickel (45%), an alloy of copper (86%) to manganese (12%) to nickel (2%), or an alloy of nickel (75%) to chromium (20%) to aluminum (2.5%) to copper (2.5%). The heating element is optionally one heating coil, either disposed in a single coil or disposed into two coils, one above the other, connected by a screw-like spiral at the center of the two coils. The heating coil is optionally a single ribbon coil or a double-back ribbon coil. Alternatively, the heating element is multiple coils configured as one above the other, connected by a conductive material. The conductive material can be formed into a bracket or clip, which attaches to one end of each heating coil. For example, the radiant heater optionally includes a first heating coil of resistive ribbon having a first end and a second end. Alternatively, the first end of the first heating coil is circumscribed by the first heating coil and the second end of the first heating coil extends from a coil in the first heating coil, i.e. the coil wraps around the first end, with the second end extending away from the wrap. A second heating coil of resistive ribbon, with a first end and a second end, is configured similarly, with the first end of the second heating coil is circumscribed by the second heating coil and the second end of the second heating coil extends from a coil in the second heating coil. The heating coils optionally possess a circular cross section, triangular cross section, square cross section, pentagonal cross section, hexagonal cross section, heptagonal cross section, octagonal cross section, or nonagonal cross section.

The one or more heating coils are formed of resistance ribbon. In some embodiments, the resistance ribbon possesses a thickness and width of about 0.0285 inches×about 0.1875 inches (0.72 mm×4.7 mm). For example, the ribbon can have a thickness of 0.025 inches, 0.026 inches, 0.027 inches, 0.0275 inches, 0.028 inches, 0.0285 inches, 0.029 inches, 0.0295 inches, 0.030 inches, 0.0305 inches, 0.031 inches. The ribbon can have an exemplary width of 0.165 inches, 0.170 inches, 0.175 inches, 0.18 inches, 0.1825 inches, 0.185 inches, 0.1875 inches, 0.189 inches, 0.19 inches, 0.1925 inches, 0.195 inches. However, these numbers are examples only and not intended to be limiting. Of particular note, the wire should possess dimensions sufficient to form a heating element having a final impedance of about 0.7Ω. Nonlimiting examples include 0.6Ω, 0.625Ω, 0.65Ω, 0.66Ω, 0.67Ω, 0.68Ω, 0.69Ω, 0.70Ω, 0.71Ω, 0.72Ω, 0.725Ω, 0.73Ω, 0.74Ω, 0.75 Ω, 0.76Ω, 0.77Ω, 0.78Ω, 0.79Ω, and 0.80Ω. Increasing the width and/or thickness reduces resistance and requires a longer length to obtain the resistance needed. However, it would be known to one of skill in the art to form the required resistance ribbon.

A heating coil connector is disposed in electrical communication with the first end of the first heating coil and the first end of the second heating coil. The heating coil connector is formed of a conductive material capable of withstanding temperatures above 1000° F. Examples include steel or steel alloys such as stainless steel.

In some variations, the one or more heating elements include at least one insulated mounting bracket disposed on an exterior circumference of the heating coil, or heating coils in the embodiment where multiple heating coils are utilized. In some variations, more than one insulated mounting bracket is provided. The insulated mounting bracket or brackets are optionally configured to hold the heating coil in place in the chimney. In specific variations, the mounting bracket includes a support which extends from a lower edge of the insulated mounting bracket body, i.e. supports the lower edge of the bottom-most heating element. Regardless of the variation of heating coil, the upper edge of the upper-most heating element is exposed to ambient environmental conditions, i.e. there is no lid, cap, or other structure disposed above the heating coils to prevent heat from escaping.

The support structure is either a fused support device or a mounting system. Where the support structure is a fused support device, the fused support device includes a chimney having an interior space defined by at least one wall and dimensioned to accept the heating element within the interior space, fused to one side of a heating plate. The fused heating plate includes an upper face, a lower face, at least one edge, and at least one vent disposed on the plate. At least one projection disposed on the at least one edge of the fused heating plate. The chimney is dimensioned such that the upper edge of the heating element does not extend beyond the upper edge of the at least one wall.

The support structure and heat transfer plate can be formed of cast aluminum, A10 aluminum, A12 aluminum, brass, gold, silver, stainless steel. The insulated brackets and spacers are optionally formed of Macor, a fluorphlogopite mica-borosilicate ceramic having a composition of about 46% silica, about 17% magnesium oxide, about 16% aluminum oxide, about 10% potassium oxide, about 7% boron trioxide, and about 4% fluorine. The insulated brackets and spacers are alternatively a compost ion of 65-70% silica, 20-25% aluminum trioxide ($Al_2O_3$), less than 1% magnesium oxide, less than 1% calcium oxide, 3-5% potassium/sodium oxide (K, $Na_2O$), less than 1% titanium dioxide, 102% iron oxide ($Fe_2O_3$), and 1-2% chromium oxide ($Cr_2O_3$). The insulation is optionally AP 508 gray porcelain (Akron Porcelain & Plastics Co., Akron, Ohio).

Where the support structure is a mounting system, the mounting system includes an independent heating plate with at least one mount. The independent heating plate comprising an upper face, a lower face, at least one edge, and at least one vent disposed on the plate. At least one projection is disposed on the at least one edge of the independent heating plate. A chimney having an interior space defined by at least one wall and dimensioned to accept the heating element within the interior space. The upper edge of the heating element does not extend beyond the upper edge of the at least one wall. A mounting block is disposed on the edge of the chimney. The chimney is dimensioned to accept to the exterior circumference of the first heating coil and the exterior circumference of the second heating coil. The chimney has a circular cross section, triangular cross section, square cross section, pentagonal cross section, hexagonal cross section, heptagonal cross section, octagonal cross section, or nonagonal cross section. At least one mount channel is disposed on the side of the mounting block and dimensioned to accept the at least one mount disposed on the edge of the heating. The at least one mount is a post, tab, pin, screw hole, or arc-shaped projection. In some variations, a second mount channel is disposed on a second side of the mounting block and dimensioned to accept a second mount. Where the mount is a screw hole, a screw attaches the mount and mount channel.

The heating plate includes at least one projection disposed on the at least one edge of the fused heating plate. The projections are optionally a plurality of cooling ribs, a cooling ring, or a plurality of cooling vanes. Optionally, the projections are cooling ribs having a thickness of about 3.9 mm for each rib. For example, the rib can be 3.6 mm, 3.7 mm, 3.8 mm, 3.9 mm, 4.0 mm, 4.1 mm, or 4.2 mm. The cooling ribs are optionally spaced apart by about 3.9 mm. For example, the rib can be 3.6 mm, 3.7 mm, 3.8 mm, 3.9 mm, 4.0 mm, 4.1 mm, or 4.2 mm.

A plurality of nubs are optionally disposed on the lower face. The lower face of the fused heating plate or lower face of the independent heating plate is optionally adapted to engage the upper edge of a hookah head.

A ventilation space disposed between the lower edge of the chimney and the upper face of the fused heating plate or upper face of the independent heating plate, where the ventilation space is about 1 mm to about 10 mm. Non-limiting examples include 1.0 mm, 1.25 mm, 1.5 mm, 1.75 mm, 2.0 mm, 2.1 mm, 2.2 mm, 2.3 mm, 2.4 mm, 2.5 mm, 2.6 mm, 2.7 mm, 2.8 mm, 2.9 mm, 3.0 mm, 3.1 mm, 3.2 mm, 3.3 mm, 3.4 mm, 3.5 mm, 3.6 mm, 3.7 mm, 3.8 mm, 3.9 mm, 4.0 mm, 4.1 mm, 4.2 mm, 4.3 mm, 4.4 mm, 4.5 mm, 4.6 mm, 4.7 mm, 4.8 mm, 4.9 mm, 5.0 mm, 5.1 mm, 5.2 mm, 5.3 mm, 5.4 mm, 5.5 mm, 5.6 mm, 5.7 mm, 5.8 mm, 5.9 mm, 6.0 mm, 6.25 mm, 6.5 mm, 6.75 mm, 7.0 mm, 7.25 mm, 7.5 mm, 7.75 mm, 8.0 mm, 8.25 mm, 8.5 mm, 8.75 mm, 9.0 mm, 9.25 mm, 9.5 mm, 9.75 mm, and 10 mm. In some variations, the ventilation space is 3 mm.

An electrical source in an electrical communication with the at least one heating coil.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

As used herein, "about" means approximately or nearly and in the context of a numerical value or range set forth means±20% of the numerical.

As used herein, "hookah" refers to a device designed for vaporizing and smoking favored materials, the vapor of which is run through a liquid before inhalation. The hookah is typically used to smoke shisha, and may have a single host or multiple hoses for inhalation.

As used herein, "heating coil" means a heating element wrapped around itself, regardless of shape. For example, the heating coil may be spiral-shaped, with each wrap radially circumscribed by the preceding wrap, or a polygonal shape, such as triangular, square, pentagonal, hexagonal, heptagonal, and octagonal. Other shapes would be readily apparent and are envisioned in the invention.

Figure 1:
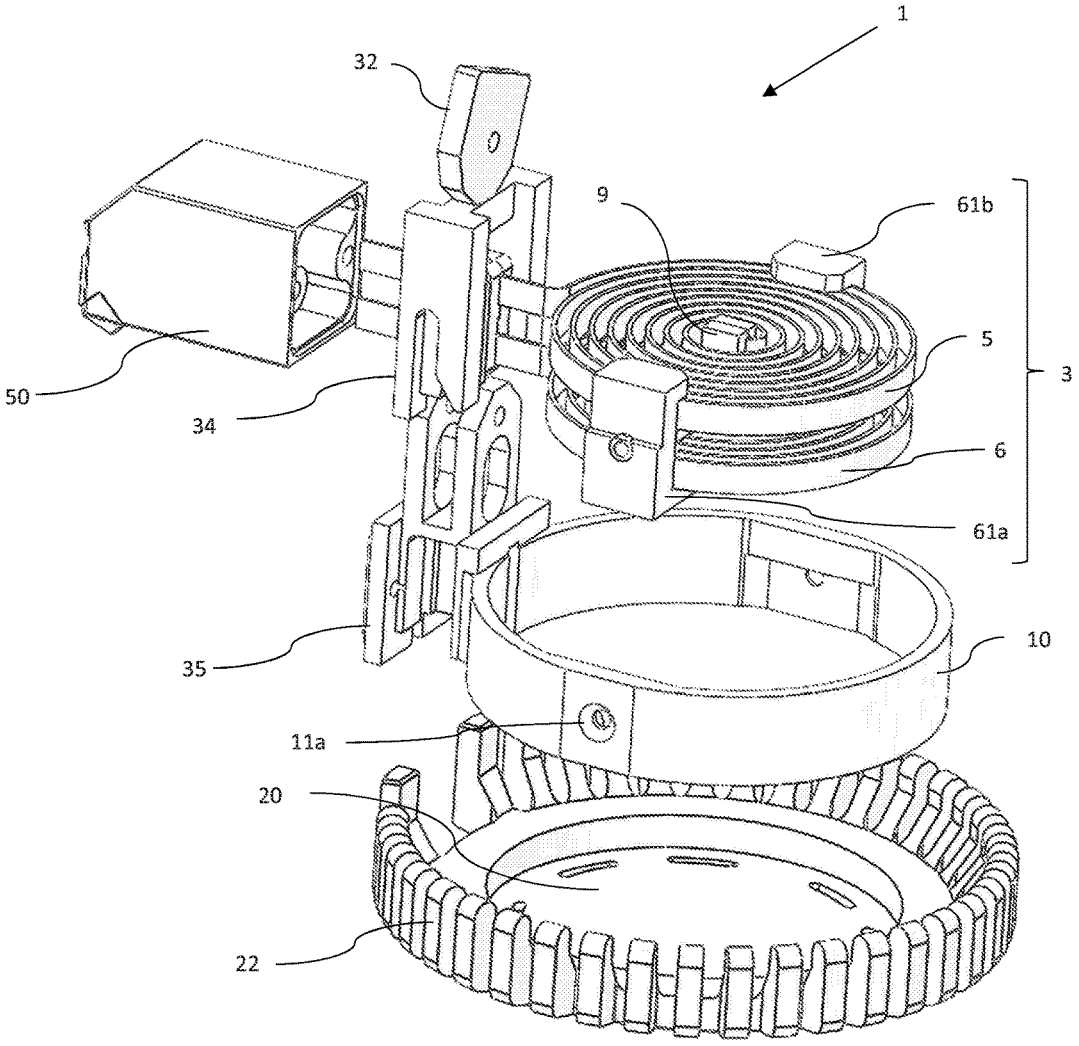
FIG. 1 is an isometric, breakaway view of a first embodiment of the radiant heater of the invention.

As used herein, "upper" and "lower" or "bottom" are referenced on the image depicted in FIG. 1. "Upper" means any portion of the sheath directed to the top in FIG. 1. For example, reference number 5 is above reference number 6. The "upper edge" references the terminal section of an element directed at the top of the Figure. "Lower" or "bottom" is directed toward the bottom of FIG. 1.

As used herein, "ambient environment" and derivations thereof mean the environment surrounding and outside of the device, as compared to the interior regions and spaces of the device. As a non-limiting example, the ambient environment includes the humidity, temperature, and air particulates 6 inches above the heating elements.

As used herein, "projection" means any structure which by design, is raised or protrudes beyond the face of the structure upon which the projection is disposed As used herein, "circumference" means the outermost boundary of the referenced structure.

As used herein, "arc-shaped" means that the structure has a convex or concave shape that resemble sections of circles, ellipses, involute curves, and spirals, without forming a full circle, or ellipse.

As used herein, "rib" refers to a major structural elevation in the heat transfer plate, where the length of the structure is an order of magnitude larger than the width, and the width and thickness are substantially the same. For example, the length can be 5 times larger, 10 time larger, or 20 times larger than the width. It is noted that the magnitudes listed are illustrative and are not intended to limit the scope of the invention. Other magnitudes are within one of skill in the art and are envisioned in the invention.

As used herein, "vane" refers to a major structural elevation in the heat transfer plate, where the length of the structure is an order of magnitude larger than the width, and where the width is an order of magnitude larger than the thickness. For example, the length can be 5 times larger, 10 time larger, or 20 times larger than the width. Similarly, the width can be 10 time larger, 20 times larger, 100 time larger than the thickness. It is noted that the magnitudes listed are illustrative and are not intended to limit the scope of the invention. Other magnitudes are within one of skill in the art and are envisioned in the invention.

As used herein, "nub" means a small projection or protuberance. In specific embodiments, the length of the nub is equal to or less than the width or circumference of the structure.

As used herein, "resistive ribbon" means a resistance wire having a length, width, and thickness, where the width is at least 2 times the value of the thickness. In some embodiments, the resistive ribbon possesses both high resistivity and oxidation resistance.

As used herein, "resistance cable" means a resistance wire having a length, width, and thickness, where the width is less than 2 times the value of the thickness. In some embodiments, the resistive cable possesses a width than is substantially the same as the thickness, i.e. possess a 1:1 ratio. Circular wire is of particular note, having a width to thickness ratio of close to, or equal to 1:1.

Figure 3:
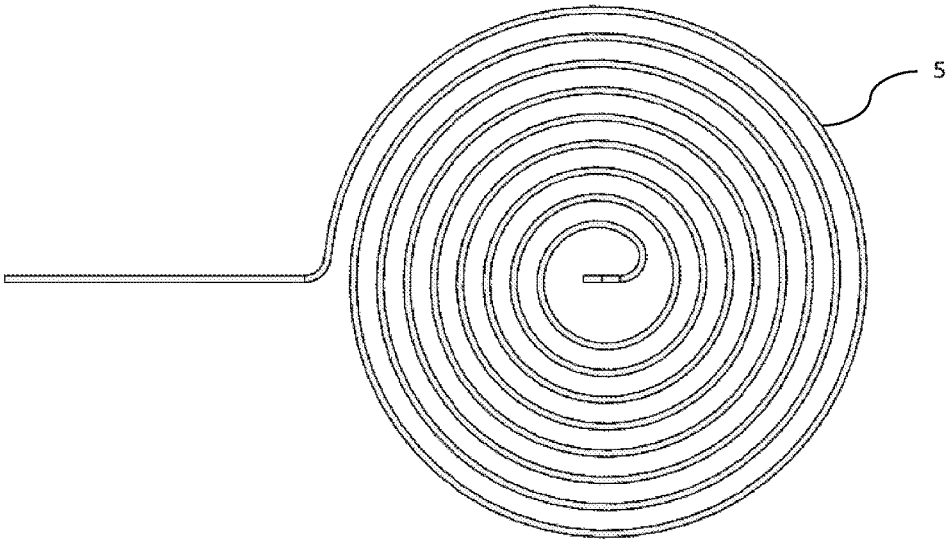
FIG. 3 is a top down view of a first embodiment of the heating coil.

As used herein, "a single ribbon coil" means a coil wrapped around itself, having a first terminal end outside the wrapping and a second terminal end at the core of the wrapping, regardless of shape. For example, where the heating coil is spiral-shaped, the first terminal end extends from a radially circumscribed coil and the second terminal end is disposed at the center-most point of the coil, as seen in FIG. 3.

As used herein, "a center spiral two layer ribbon coil" means a coil wrapped around itself, wherein the central 1/20-1/5 of the coil is spiraled from a lower tier coil to an upper tier coil, similar to the threads of a screw, forming two layers or tiers of heater coil.

Figure 12:
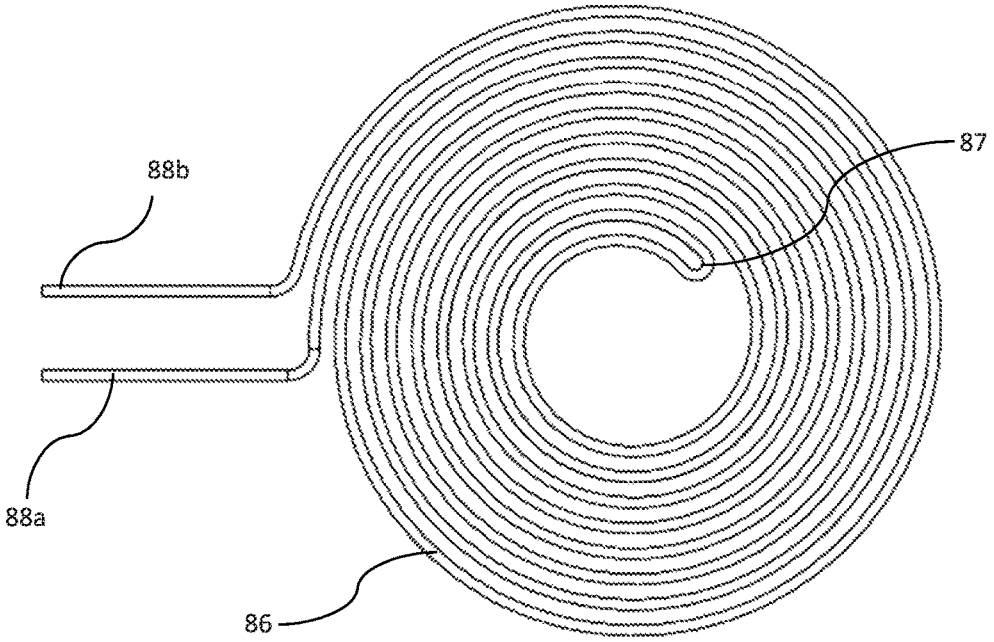
FIG. 12 is a top down view of a third embodiment of the heating element.

As used herein, "double-back ribbon coil" means a coil folded upon itself and subsequently wrapped around itself. The double-back ribbon coil has a first terminal end and a second terminal end disposed outside the wrapping. The center-most point of the coil possesses the fold, as seen in FIG. 12.

As used herein, "substantially" means largely if not wholly that which is specified but so close that the difference is insignificant.

A hookah electric radiant heating system is provided for vaporizing tobacco without burning the tobacco. Burning or charring tobacco results in unpleasant volatile gases, ultrafine particulates and ash. The system includes a heating element, set in an open faced mounting ring such that the heating element optionally moves in relation to the mounting ring to control heat. The system is designed to transfer heat to a heat transfer plate which applies heat to tobacco in a hookah head.

Example 1

Figure 2:
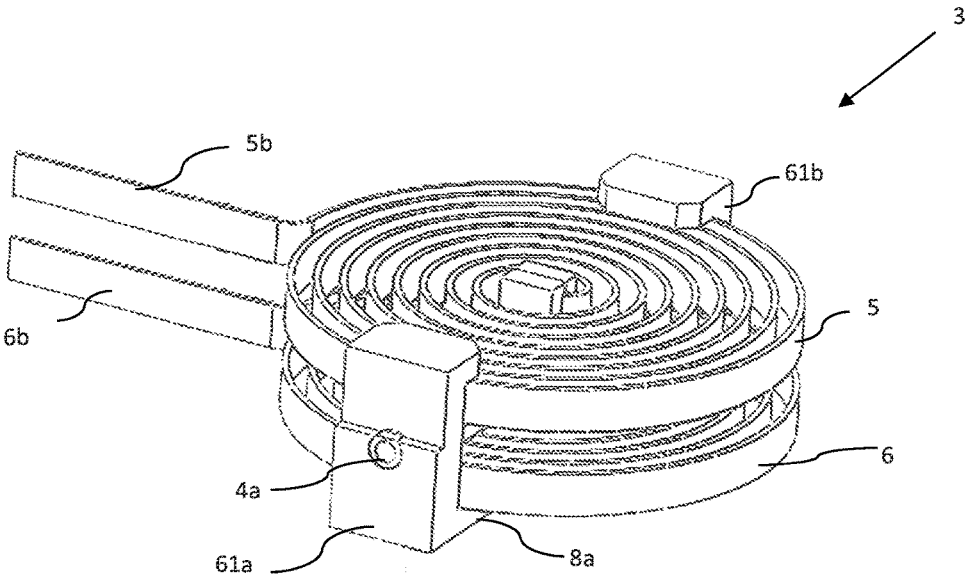
FIG. 2 is an isometric view of a first embodiment of the heating element of the invention.

Radiant heater 1 is composed of heating element 3, heating plate 20, mounting system 30, and supply system (not shown), as seen in FIG. 1. Heating element 3 is comprised of upper heating coil 5 and lower heating coil 6, where upper heating coil 5 and lower heating coil 6 are resistive wire ribbon connected at a predetermined set distance by first insulated mounting bracket 61*a* and second insulated mounting bracket 61*b*, as seen in FIG. 2. Each heating coil is formed of nickel (80%) to chromium (20%) resistance ribbon with a thickness of 0.0285 inches and a width of 0.1875 inches. The total resistance of both upper heating coil 5 and lower heating coil 6 is 0.7Ω. First insulated mounting bracket 61*a* includes first lower support 8*a* on its lower edge. Second insulated mounting bracket 61*b* is positioned at a different location to first insulated mounting bracket 61*a* and includes second lower support 8*b* (not shown). First lower support 8*a* and second lower support 8*b* provide support to the heating coils, preventing the coils from sagging or otherwise contacting heat transfer plate 20. First screw 4*a* is disposed in first insulated mounting bracket 7*a*, thereby fixing first insulated mounting bracket 7*a* to chimney 10. The upper heating coil and lower heating coil are single ribbon coil designs, as seen in FIG. 3, electrically connected by heating coil connector 9. The connector is formed of steel or other electroconductive material, whereas the insulated mounting brackets are made of a fluorphlogopite mica-borosilicate ceramic insulation (Macor, Corning Inc., Corning, N.Y.). Upper heating coil 5 terminates in upper supply line 5*b* designed to engage electric source and lower heating coil 6 terminates in lower supply line 6*b* designed to engage electric source. Upper supply line 5*b* and lower supply line 6*b* are disposed in supply housing 50.

Mounting system 30 is formed of cast aluminum and encircles heating element 3 and holds heating element 3 at a predetermined orientation relative to head 110 when radiant heater 1 is configured for heating tobacco. Furthermore, in this embodiment mounting system 30 permits height adjustment in relation to the heating plate to control heat transfer to the tobacco.

Figure 4:
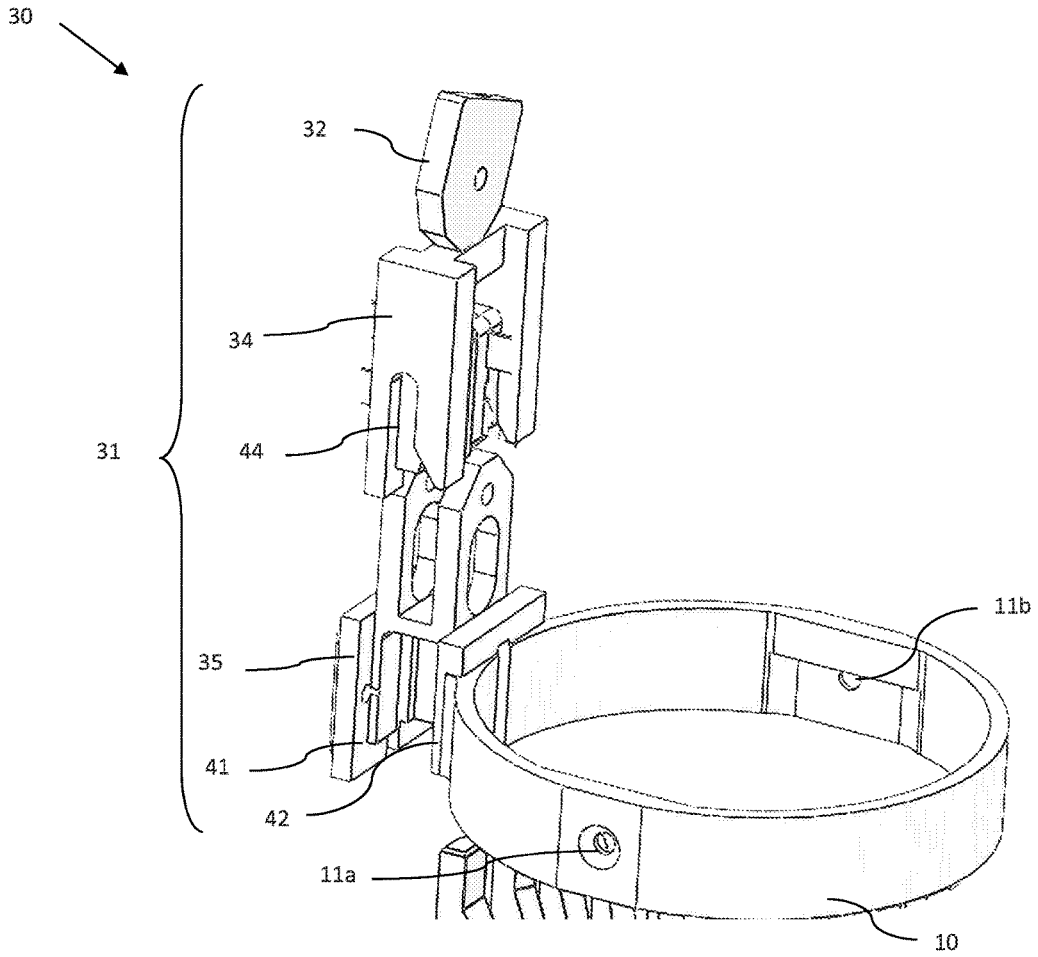
FIG. 4 an isometric view of a first embodiment of the mounting system of the invention.

Mounting system 30 includes chimney 10 which retains heating element 3 and directs air flow and heat through radiant heater 1. One or more screw ports, such as first screw port 11*a* and second screw port 11*b* are disposed along the circumference of chimney 10, as seen in FIG. 4. Mount 31 is fixed to chimney 10 and engages heat transfer plate 20. Mounting system 30 is designed to adjust in height, mount 31 consists of slide mount 34, guide block 35, and height adjustment tab 32. Guide block 35 includes exterior lower slide guide 41 and interior lower slide guide 42, designed to engage slide mount 34. Slide mount 34 includes first slide mount channel 44*a* and second slide mount channel 44*b* (not shown) dimensioned to slidingly engage first slide rib 24 and second slide rib 25.

Figure 5:
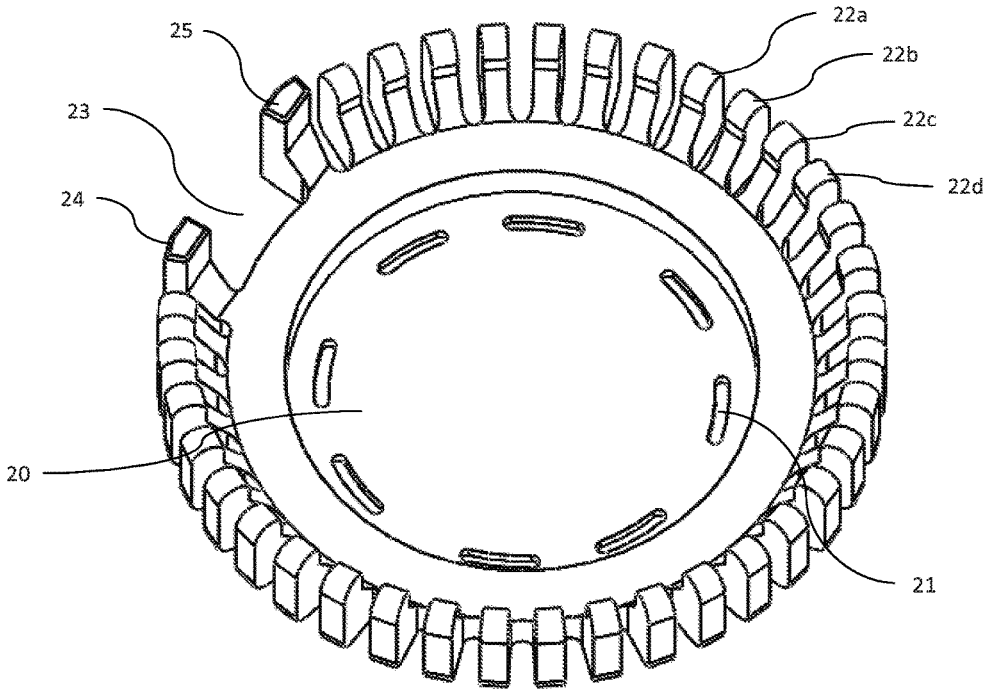
FIG. 5 is a top isometric view of a first embodiment of the heat transfer plate of the invention.
Figure 6:
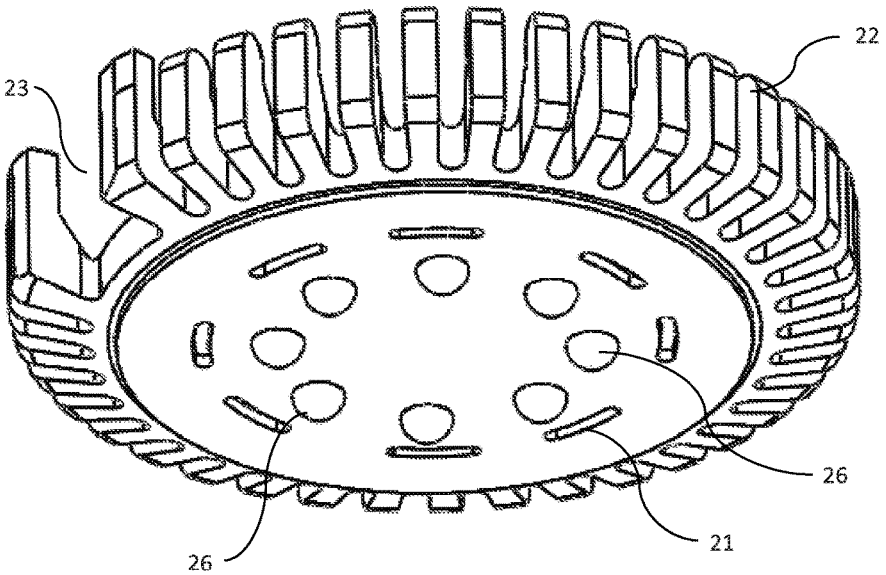
FIG. 6 is a bottom isometric view of a first embodiment of the heat transfer plate of the invention.
Figure 7:
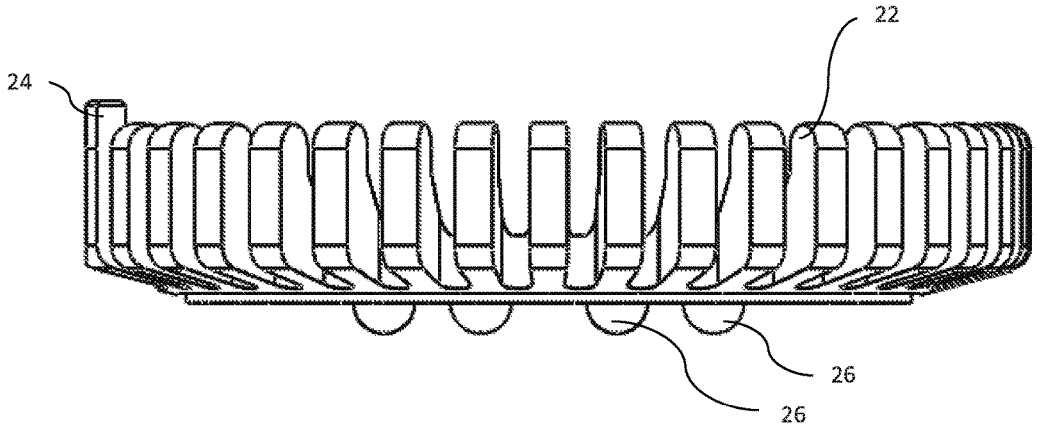
FIG. 7 is a side view of a first embodiment of the heat transfer plate of the invention.

Heat transfer plate 20 comprises a plurality of cooling ribs, designated 22*a* through 22*d* in FIG. 5. Each rib has a thickness of about 3.9 mm and spaced apart about 3.9 mm. One or more vents 21 are optionally disposed on the heat transfer plate. In some embodiments, a plurality of vents are disposed on the heat transfer plate. As air is drawn through the heater, and through the plurality of vents, the hot air that passed over the heating elements mixes with cooler air siphoned from outside the chimney due to the 3 mm gap between the chimney and the heat transfer plate. Mount channel 23 is disposed on the edge of the plate, and dimensioned to permit mounting system 30 to mount to the edge of heat transfer plate 20. First slide rib 24 is mounted adjacent to a first side of mount channel 23 and second slide rib 25 mounted adjacent to a second side of mount channel 23, as seen in FIG. 5. In specific variations, a plurality of nubs 26 are disposed on the lower face of the heat transfer plate, allowing heat from the plate to access the tobacco on the bottom of the head, allowing for more even heating of the tobacco. A plurality of heating nubs 26 are disposed on the lower face of heat transfer plate 20, as seen in FIG. 6, allowing heat to transfer through the tobacco via the metallic nubs. While the nubs can be any shape and can vary in depth, the nubs advantageously are round or ovoid, as seen in FIG. 7.

Figure 8:
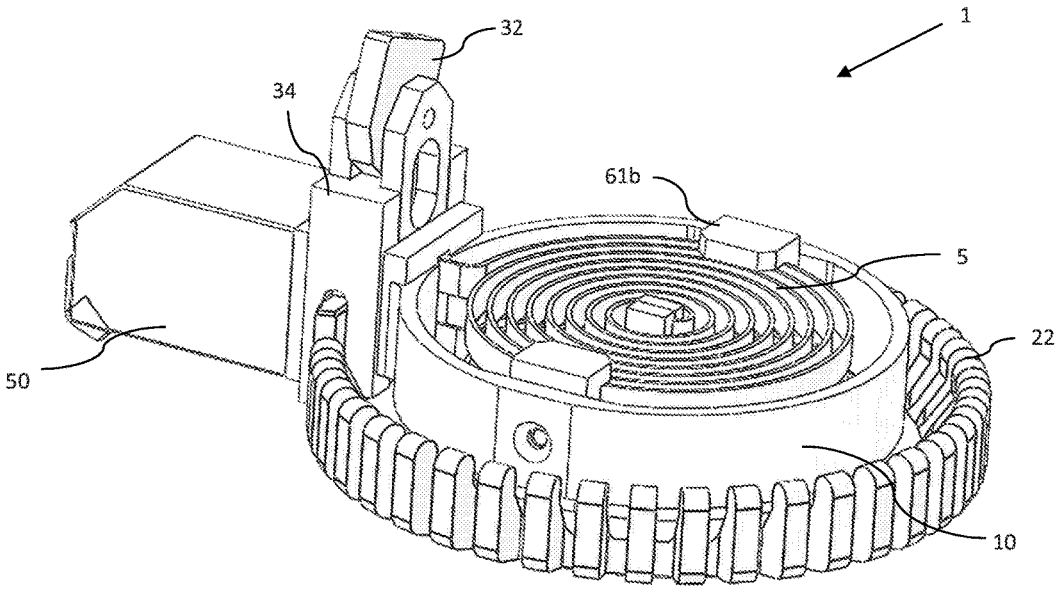
FIG. 8 is an isometric view of a first embodiment of the radiant heater of the invention.

When mount system 30 is attached to heat transfer plate 20, as seen in FIG. 8, the distance between chimney 10 and heat transfer plate 20 is about 3 mm. Heating elements are preferably set to reach a lower point around 3 mm from heat transfer plate and can be raised as needed to reduce heat transfer to the head. Pivoting of height adjustment tab 32 places pressure on slide mount 34 forcing the mounting system up and down to provide height adjustment.

An electric source comprises an electric supply circuit to provide an electrical current to upper heating coil 5 and lower heating coil 6. Power is supplied through electric source 50 to provide 12 V to 18 V and a resultant current of about 17 to 25 Amperes.

Example 2

Figure 9A:
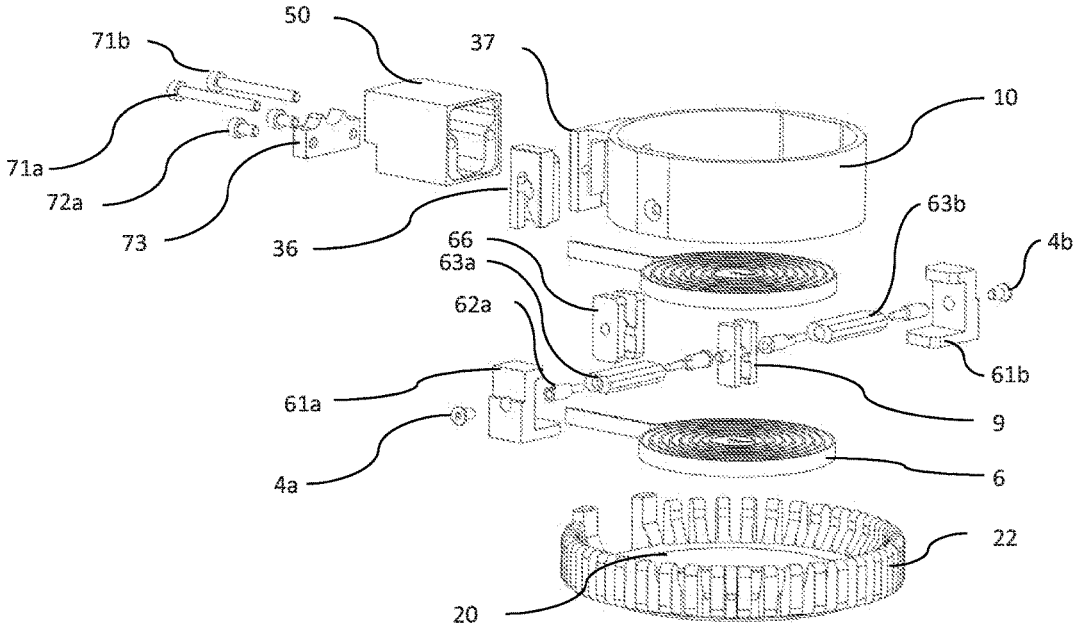
FIG. 9*a* is an isometric, breakaway view of a second embodiment of the radiant heater of the invention.

Radiant heater 1 is composed of heating element 3, mounting system 30, and heating plate 20, as in Example 1. Upper heating coil 5 and lower heating coil 6 are formed of resistive wire ribbon as discussed in Example 1. As seen in more detail, upper heating coil 5 and lower heating coil 6 are supported by first insulated side bracket 61*a* and second insulated side bracket 61*b*. First insulated side bracket 61*a* is attached to first mount retainer 62*a*, which is made of metal such as steel, stainless steel, or aluminum, by first screw 4*a*. First exterior mount retainer 62*a* is encased in a first side of insulated spacer 63*a*. First interior mount retainer 64*a* is encased in a second side of insulated spacer 63*a* and attaches insulated spacer 63*a* to heating coil connector 9, as seen in FIG. 9*a*. Second exterior mount retainer 62*b* is encased in a first side of insulated spacer 63*b* and accepts second screw 4*b*, thereby fixing second insulated side bracket 61*b*. Second interior mount retainer 64*b* is encased in a second side of insulated spacer 63*b* and attaches insulated spacer 63*b* to heating coil connector 9, opposite to insulated spacer 63*a*. Lower heating coil 6 attaches to the lower half of heating coil connector 9, and is further supported on its lower edge by lower arms on first insulated side bracket 61*a* and second insulated side bracket 61*b*. Upper heating coil 5 attaches to the upper half of heating coil connector 9. Upper supply line 5*b* attaches to the upper portion of insulated bracket 66, and lower supply line 6*b* to the lower portion of insulated bracket 66. Insulated bracket 66 includes channels or cut outs designed to accept upper supply line 5*b* or lower supply line 6*b* and hold each supply line in place.

Heat transfer plate 20 comprises a plurality of cooling ribs, designated 22*a* through 22*d* as well as first slide rib 24 and second slide rib 25, mounted adjacent to mount channel 23, as seen in FIG. 5. One or more vents 21 are optionally disposed on the heat transfer plate. In specific variations, a plurality of nubs are disposed on the lower face of the heat transfer plate, as described in Example 1.

Figure 9B:
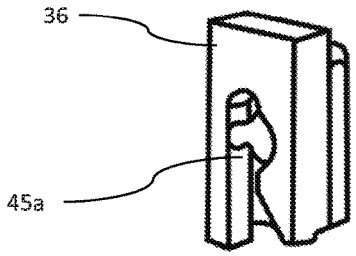
FIG. 9*b* is an isometric view of an embodiment of the mounting block.
Figure 10:
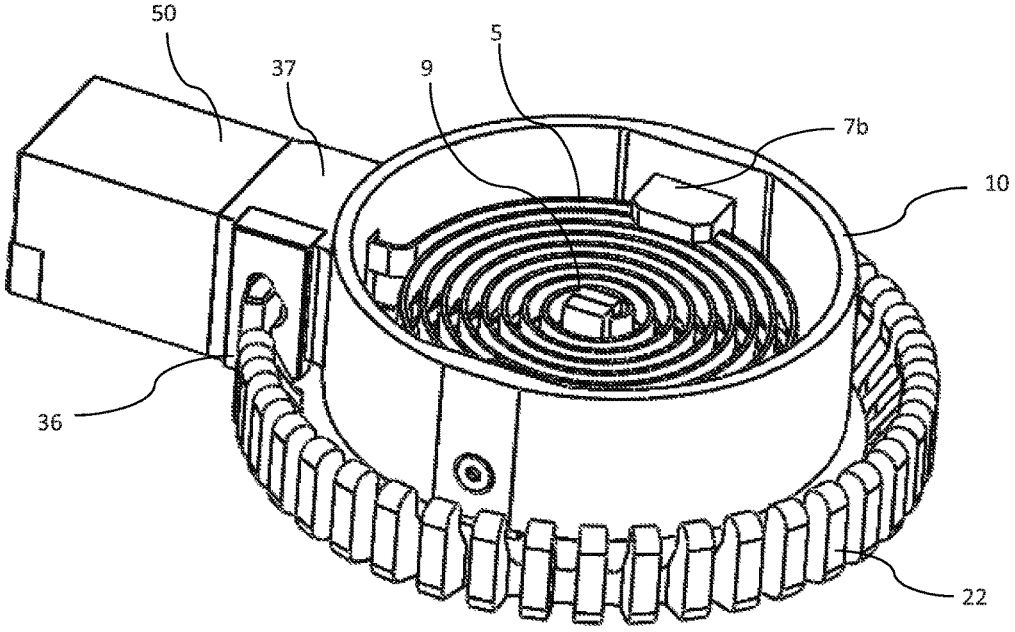
FIG. 10 is an isometric view of a second embodiment of the radiant heater of the invention.

Mount bracket 37 is fixed to chimney 10 and is designed to accept mount block 36. Mount block 36 includes first mount block channel 45*a*, as seen in FIG. 9*b*, and second mount block channel 45*b* (not shown). First mount block channel 45*a* and second mount block channel 45*b* engage first slide rib 24 and second slide rib 25 to fix mounting system 30 to heat transfer plate 20, seen in FIG. 10. Mount block 36 is dimensioned to support the weight of the mounting ring and heating element, such that the distance between chimney 10 and heat transfer plate 20 is 3 mm.

Electricity is provided to the heating elements as described in Example 1. Mount bracket 37 is designed to accept insulated bracket 66. Supply housing 50 is mounted to mounting system 30 via mounting pins 71*a* and 71*b*. A power supply cable (not shown) is clamped to supply housing 50 using cable mounting plate 73 and cable mounting pins 72*a* and 72*b*.

Example 3

Development of heating element 3 began with resistance cable 80. Numerous designs were prepared, including a coil, similar to those with resistance ribbon seen in FIG. 3.

Figure 11:
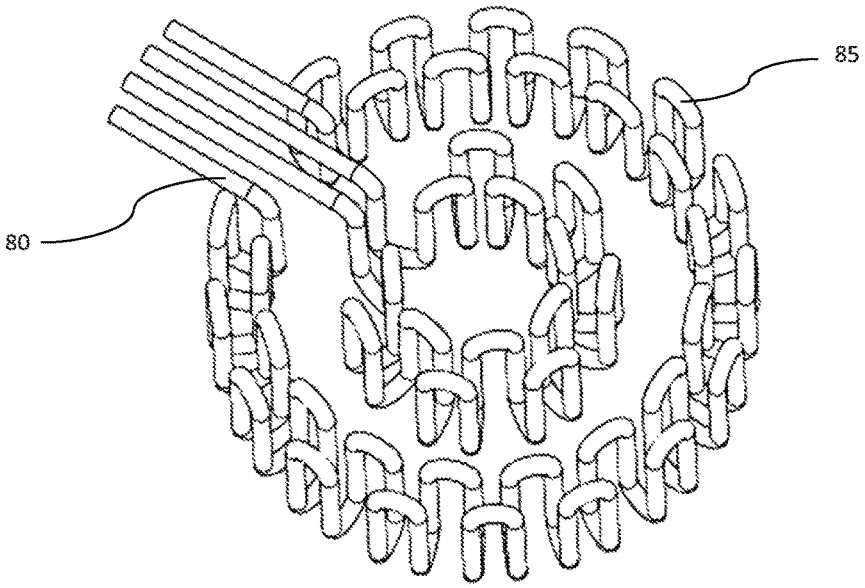
FIG. 11 is an isometric view of a second embodiment of the heating element.

During testing, the resistance cable was found to lack sufficient energy to maintain temperature. As air was drawn past the heating element, the air cooled the resistance cable such that the resistance cable dropped below temperatures required to vaporize the tobacco. To compensate for the drop in temperature, the resistance cable was heated to higher temperatures, which resulted in the tobacco burning. Because the distance of the resistance wire dictates impedance, resistance cable 80 was formed into corrugated coils 85, as seen in FIG. 11. This design also permitted increases in cable thickness. While this improved the thermal retention of the resistance cable, the design still lost too much heat to adequately heat the tobacco without burning. Addition designs utilizing the resistance cable did not improve on the thermal retention and transfer properties. As such, it was deemed that resistance cable was insufficient for use in heating tobacco.

Example 4

Heating element 3 designs included a double back ribbon coil, as seen in FIG. 12. Resistance ribbon 86 was coiled into a spiral to a center, where reverse coil 87 results in the coil coiling back upon itself. This results in the two ends of the resistance ribbon 86 extending from the coil, forming first double back supply line 88*a* and second double back supply line 88*b*. The designs were formed to generate a temperature range of about 600° F. to about 1000° F. with between about 18 and about 22 Amps. Furthermore, the ribbon must retain sufficient energy such that an airstream resulting from use of a hookah does not result in the heating element dropping below 600° F. Accordingly, the resistance ribbon used has a thickness and width of 0.0285 inches×0.1875 inches (0.72 mm×4.7 mm).

Example 5

Figure 13:
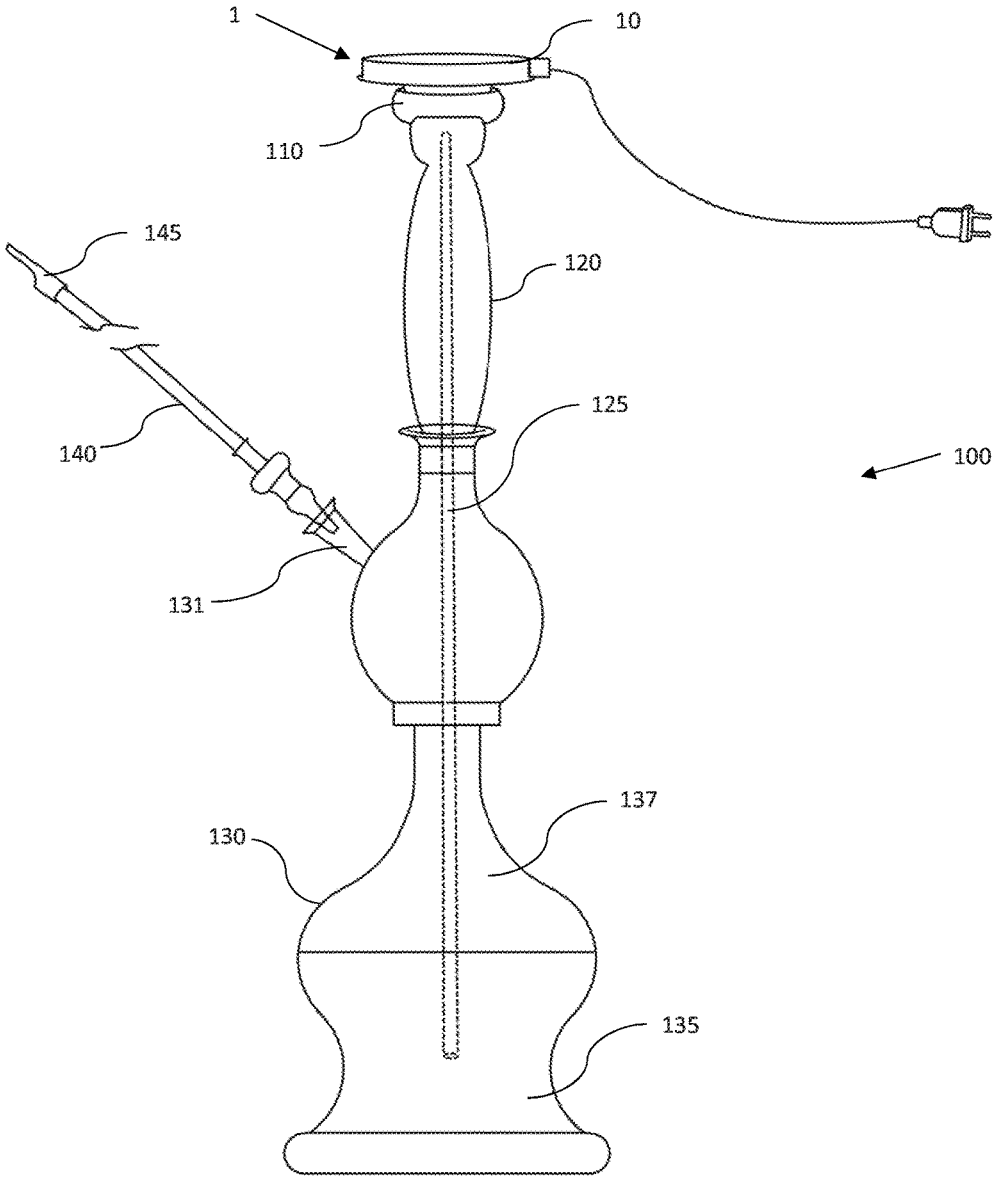
FIG. 13 is a cut away view of a hookah with an embodiment of the invention attached to the head.

Hookah 100 is prepared for use as commonly known in the art, with vase 130 comprising water 135 with head space 137 immediately above water 135, seen in FIG. 13. Hose 140 connects to vase 130 at port 131 via a first end and thereby directly accesses dead space 137. Mouthpiece 145 connects to a second end of hose 140. Body 120 is mounted onto vase 130, such that channel 125, located in the interior of body 120 is positioned to enable the lower end of the channel to submerge in water 135. The lower portion of body 120 forms a seal with an upper opening in vase 130. Head 110 is mounted to the upper portion of body 120 and in fluid communication with channel 125. Head 110 is made of a material capable of withstanding temperatures needed to vaporize the combustible material, such as glass, ceramic, or steel. Tobacco or other combustible material is placed in head 110.

Figure 14:
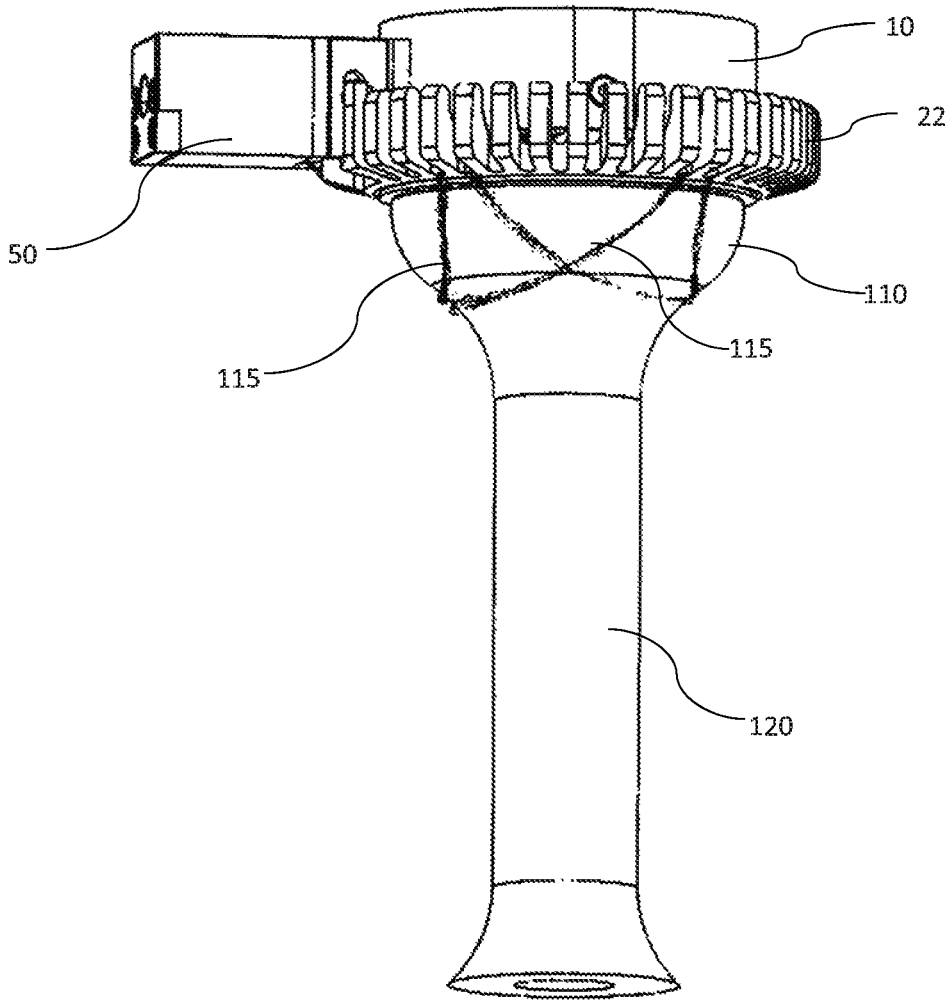
FIG. 14 is an isometric view of the inventive heater attached to a hookah head using silicon rubber bands.

Radiant heater 1 is mounted on top of head 110. Heat transfer plate 20 is placed onto the upper edge of head 110. In some embodiments, heat transfer plate possesses a lower lip, designed to fit on the upper edge of head 110. One or more silicon rubber bands 115 are attached to opposing ribs, such that the rubber bands traverse the lower flair of head 110, as seen in FIG. 14 thereby securing heat transfer plate 20 to head 110. The remaining sections of radiant heater 1 are assembled as described in Example 1. The upper edge of radiant heater 1 is not covered, allowing heat to escape. Testing showed that covering the upper surface of the heating element resulted in overly high temperatures that burned the combustible material, as noted above.

The distance of upper heating coil 5 and lower heating coil 6 to heat transfer plate 10 is adjusted using height adjustment tab 32. The radiant heater is connected to an electrical source providing about 12-18 V and a current of about 17 to 25 Amperes and the heater elements warmed up. Electrical current causing upper heating coil 5 and lower heating coil 6 to generate heat pursuant to Joule's first law. A user draws air through mouthpiece 145, resulting in a vacuum in the head space of the vase. The vacuum draws air from the head. At the head, air travels past heater elements, warming the air. Cooler air is drawn into the area below the heater elements via the ventilation space between the chimney and heat transfer plate, and mixes with the heated air. The mixed air is drawn through the plurality of vents and into the tobacco, heating the glycerin and aromatic oils in the tobacco to vaporization. The airflow draws the vapor smoke into the body channel, whereupon the vapor smoke is pulled into water in the vase, forming smoke vapor bubbles in the water that filter the raw smoke vapor. The smoke vapor then enters a head space in the vase, where it is drawn to the user.

Example 6

Hookah 100 is prepared as described in Example 5, and tobacco or other combustible material is placed in head 110. Heat transfer plate 20 is placed onto the upper edge of head 110. In some embodiments, heat transfer plate possesses a lower lip, designed to fit on the upper edge of head 110. One or more silicon rubber bands, also known as cooking rubber bands, are attached to opposing ribs, such that the rubber bands traverse the lower flair of head 110, as seen in FIG. 14, thereby securing heat transfer plate 20 to head 110. The remaining sections of radiant heater 1 are assembled as described in Example 2, with the mounting system 30 sliding onto first slide rib 24 and second slide rib 25, and mount block 36 fitting into mount channel 23. The upper edge of radiant heater 1 is not covered, allowing heat to escape. Testing showed that covering the upper surface of the heating element resulted in overly high temperatures that burned the combustible material, as noted above.

The radiant heater is connected to an electrical source providing about 12-18 V and a current of about 17 to 23 Amperes and the heater elements warmed up. Electrical current is then applied, causing upper heating coil 5 and lower heating coil 6 to generate heat pursuant to Joule's first law. A user draws air through mouthpiece 145, resulting in a vacuum in the head space of the vase. The vacuum draws air from the head. At the head, air travels past heater elements, warming the air. Cooler air is drawn into the area below the heater elements via the ventilation space between the chimney and heat transfer plate, and mixes with the heated air. In this embodiment, the ventilation space is at a fixed distance. The distance of the ventilation space and the distance the chimney extends beyond the heating elements provides a self-modulating design. When not in use, air is siphoned through the upper edge of the chimney, transferring the heat away from the tobacco. When used, the mixed air is drawn through the plurality of vents and into the tobacco, heating the tobacco to vaporization. The airflow draws the vapor smoke into the body channel, whereupon the vapor smoke is pulled into water in the vase, forming smoke vapor bubbles in the water that filter the raw smoke vapor. The smoke vapor then enters a head space in the vase, where it is drawn to the user.

In the preceding specification, all documents, acts, or information disclosed does not constitute an admission that the document, act, or information of any combination thereof was publicly available, known to the public, part of the general knowledge in the art, or was known to be relevant to solve any problem at the time of priority.

The disclosure of all publications cited above are expressly incorporated herein by reference, each in its entirety, to the same extent as if each were incorporated by reference individually.

It is also to be understood that the following claims are intended to cover all of the generic and specific features of the invention herein described, and all statements of the scope of the invention which, as a matter of language, might be said to fall therebetween.

What is claimed is:

1. A radiant heating system, comprising:

a heating element, wherein the heating element comprises:

at least one heating coil comprising resistance wire;

where an upper edge of the heating element is exposed to ambient environmental conditions;

a support structure, comprising a fused support device or a mounting system;

wherein the fused support device further comprises:

a fused heating plate, comprising an upper face, a lower face, at least one edge, and at least one vent disposed on the plate;

at least one projection disposed on the at least one edge of the fused heating plate;

a chimney having an interior space defined by at least one wall and dimensioned to accept the heating element within the interior space;

wherein the upper edge of the heating element does not extend beyond the upper edge of the at least one wall;

wherein the chimney is fused to at least an edge of the fused heating plate;

wherein the mounting system further comprises:

an independent heating plate, comprising an upper face, a lower face, at least one edge, and at least one vent disposed on the plate;

a chimney having an interior space defined by at least one wall and dimensioned to accept the heating element within the interior space;

wherein the upper edge of the heating element does not extend beyond the upper edge of the at least one wall;

a mounting block disposed on the edge of the chimney;

a ventilation space disposed between the lower edge of the chimney and the upper face of the fused heating plate or upper face of the independent heating plate;

an electrical source in an electrical communication with the at least one heating coil.

2. The radiant heating system of claim 1, wherein the at least a first mount is a post, tab, pin, screw hole, or arc-shaped projection.

3. The radiant heating system of claim 1, wherein the at least one projection disposed on the at least one edge of the fused heating plate or the at least one edge of the independent heating plate is a plurality of cooling ribs, a cooling ring, or a plurality of cooling vanes.

4. The radiant heating system of claim 1, wherein the ventilation space is about 1 mm to about 10 mm.

5. The radiant heating system of claim 1, wherein the heating element comprises a plurality of heating coils, where the plurality of heating coils comprise:

a first heating coil comprising a resistive ribbon having a first end and a second end where the first end of the first heating coil is circumscribed by the first heating coil and the second end of the first heating coil extends from a coil in the first heating coil;

a second heating coil comprising a resistive ribbon having a first end and a second end where the first end of the second heating coil is circumscribed by the second heating coil and the second end of the second heating coil extends from a coil in the second heating coil;

a heating coil connector disposed in electrical communication with the first end of the first heating coil and the first end of the second heating coil; and where the heating coil connector is a conductive material.

6. The radiant heating system of claim 1, further comprising a plurality of insulated mounting brackets disposed on an exterior circumference of the first heating coil and an exterior circumference of the second heating coil;

wherein a first insulated mounting bracket is disposed on a first side of the exterior circumference of the heating coil and a first side of the exterior circumference of the second heating coil; and wherein a second insulated mounting bracket is disposed on a second side of the exterior circumference of the heating coil.

7. The radiant heating system of claim 1, wherein the chimney has a circular cross section, triangular cross section, square cross section, pentagonal cross section, hexagonal cross section, heptagonal cross section, octagonal cross section, or nonagonal cross section.

8. The radiant heating system of claim 1, wherein the heating coil is a single ribbon coil, a double-back ribbon coil, or a center spiral two layer ribbon coil.

9. The radiant heating system of claim 1, further comprising:

at least one mount channel disposed on a first side of the mounting block and dimensioned to accept the at least one mount disposed on the edge of the heating plate.

10. The radiant heating system of claim 1, further comprising at least one rubber band dimensioned to traverse the distance between a first projection on the at least one edge of the fused heating plate or the independent heating plate and a second projection on the at least one edge of the fused heating plate or the independent heating plate.

11. A radiant heating system, comprising:

a heating element, wherein the heating element comprises:

at least one heating coil comprising resistance wire;

where an upper edge of the heating element is exposed to ambient environmental conditions;

a support structure, comprising a fused support device or a mounting system;

wherein the fused support device further comprises:

a fused heating plate, comprising an upper face, a lower face, at least one edge, and at least one vent disposed on the plate;

at least one projection disposed on the at least one edge of the fused heating plate;

a chimney having an interior space defined by at least one wall and dimensioned to accept the heating element within the interior space;

wherein the upper edge of the heating element is does not extend beyond the upper edge of the at least one wall;

wherein the chimney is fused to at least an edge of the fused heating plate;

wherein the mounting system further comprises:

an independent heating plate, comprising an upper face, a lower face, at least one edge, and at least one vent disposed on the plate;

a chimney having an interior space defined by at least one wall and dimensioned to accept the heating element within the interior space;

wherein the upper edge of the heating element is does not extend beyond the upper edge of the at least one wall;

a mounting block disposed on the edge of the chimney;

a ventilation space disposed between the lower edge of the chimney and the upper face of the fused heating plate or upper face of the independent heating plate, wherein the ventilation space is about 1 mm to about 10 mm;

wherein the lower face of the fused heating plate or independent heating plate is adapted to fit on the upper edge of a hookah head;

an electrical source in an electrical communication with the at least one heating coil.

12. The radiant heating system of claim 11, wherein the at least a first mount is a post, tab, pin, screw hole, or arc-shaped projection.

13. The radiant heating system of claim 11, wherein the at least one projection disposed on the at least one edge of the fused heating plate or the at least one edge of the independent heating plate is a plurality of cooling ribs, a cooling ring, or a plurality of cooling vanes.

14. The radiant heating system of claim 11, wherein the heating element comprises a plurality of heating coils, where the plurality of heating coils comprise:

a first heating coil comprising a resistive ribbon having a first end and a second end where the first end of the first heating coil is circumscribed by the first heating coil and the second end of the first heating coil extends from a coil in the first heating coil;

a second heating coil comprising a resistive ribbon having a first end and a second end where the first end of the second heating coil is circumscribed by the second heating coil and the second end of the second heating coil extends from a coil in the second heating coil;

a heating coil connector disposed in electrical communication with the first end of the first heating coil and the first end of the second heating coil; and where the heating coil connector is a conductive material.

15. The radiant heating system of claim 11, further comprising a plurality of insulated mounting brackets disposed on an exterior circumference of the first heating coil and an exterior circumference of the second heating coil;

wherein a first insulated mounting bracket is disposed on a first side of the exterior circumference of the heating coil and a first side of the exterior circumference of the second heating coil; and wherein a second insulated mounting bracket is disposed on a second side of the exterior circumference of the heating coil.

16. The radiant heating system of claim 11, wherein the chimney has a circular cross section, triangular cross section, square cross section, pentagonal cross section, hexagonal cross section, heptagonal cross section, octagonal cross section, or nonagonal cross section.

17. The radiant heating system of claim 11, further comprising:

at least one mount channel disposed on a first side of the mounting block and dimensioned to accept the at least one mount disposed on the edge of the heating plate.

18. The radiant heating system of claim 11, further comprising at least one rubber band dimensioned to traverse the distance between a first projection on the at least one edge of the fused heating plate or the independent heating plate and a second projection on the at least one edge of the fused heating plate or the independent heating plate.

19. The radiant heating system of claim 1, wherein the independent heating plate further comprises:

at least a first mount disposed on the edge of the independent heating plate; and at least one projection disposed on the at least one edge of the independent heating plate.

20. The radiant heating system of claim 11, wherein the independent heating plate further comprises:

at least a first mount disposed on the edge of the independent heating plate; and at least one projection disposed on the at least one edge of the independent heating plate.

* * * * *